United States Patent [19]

Plautz

[11] 4,395,196

[45] Jul. 26, 1983

[54] TURBINE SHROUD HONEYCOMB MATRIX MECHANICAL LOCKING STRUCTURE AND METHOD

[76] Inventor: John R. Plautz, 18061 Parke La., Grosse Ile, Mich. 48138

[21] Appl. No.: 146,389

[22] Filed: May 5, 1980

[51] Int. Cl.[3] ..... F01D 11/08

[52] U.S. Cl. ..... 415/174; 415/200

[58] Field of Search ..... 415/174, 200; 428/116, 428/117, 118, 593

[56] References Cited

U.S. PATENT DOCUMENTS 2,963,307 12/1960 Bobo ..... 415/174

3,126,149 3/1964 Bowers Jr., et al. ..... 415/174

FOREIGN PATENT DOCUMENTS 1197841 8/1965 Fed. Rep. of Germany ..... 428/118

1390968 6/1972 United Kingdom ..... 428/118

*Primary Examiner*—Louis J. Casaregola

*Assistant Examiner*—Jeffrey A. Simenauer

*Attorney, Agent, or Firm*—Barnes, Kisselle, Raisch, Choate, Whittemore & Hulbert

[57] ABSTRACT

A structure for and a method of mechanically locking an abrasive matrix material in honeycomb structure in a shroud for a turbine engine. The mechanical lock may be lanced portions of the honeycomb structure extending into adjacent honeycomb cells to engage the abrasive matrix material. In the method of the invention the lancing is accomplished during the manufacture of the honeycomb structure so that it engages the abrasive matrix material prior to setting thereof in the honeycomb material.

1 Claim, 9 Drawing Figures

TURBINE SHROUD HONEYCOMB MATRIX MECHANICAL LOCKING STRUCTURE AND METHOD

BACKGROUND OF THE INVENTION

1. Field of the Invention

The invention relates to turbine engine shrouds or the like and refers more specifically to a mechanical locking structure for and method of securing an abradable matrix material in a honeycomb structure on a turbine engine shroud or the like.

2. Description of the Prior Art

In the past, bonding of an abradable matrix material to honeycomb structure on turbine engine shrouds or the like has been accomplished during sintering of the matrix material. The mechanical bond provided between the matrix material and honeycomb structure has in the past been determined by the physical number of contacts between the honeycomb structure and one component of the sintered matrix material. Approximately 65 bonds per inch between nickel coated aluminum abrasive power in the sintered matrix material and steel honeycomb structure has been considered adequate to prevent the sintered matrix material from working loose from the honeycomb structure cells in which it is deposited on the shroud.

Thus, in the construction of such shrouds or shroud sections, since the shrouds are normally constructed in sections, the sintering of the abrasive material has been necessarily carefully controlled, and samples taken thereof which have been polished and the bonds between the honeycomb structure and the sintered abradable powder laboriously counted as a test of the quality of the shrouds produced. Such testing requires special equipment and is time consuming and expensive. Further, the adequacy of the bonding of the matrix material to the honeycomb structure is not well established by such tests.

SUMMARY OF THE INVENTION

The structure of the invention is mechanical locking or detent means between a honeycomb structure and matrix material positioned therein. More specifically, the structure of the invention is split and deformed honeycomb cell wall portions providing mechanical extensions of the honeycomb cell walls and an abradable matrix positioned in the honeycomb structure whereby detents are provided in the honeycomb structure to lock the matrix within the honeycomb structure.

The method of the invention comprises providing mechanical locking means between the honeycomb structure of a shroud for a turbine engine or the like and an abradable matrix within the honeycomb structure. In accordance with the method of the invention, the locking means is provided by splitting and deforming some of the walls of selected cells of the honeycomb structure during manufacturing of the honeycomb structure.

DESCRIPTION OF THE PREFERRED EMBODIMENT

Figure 1:
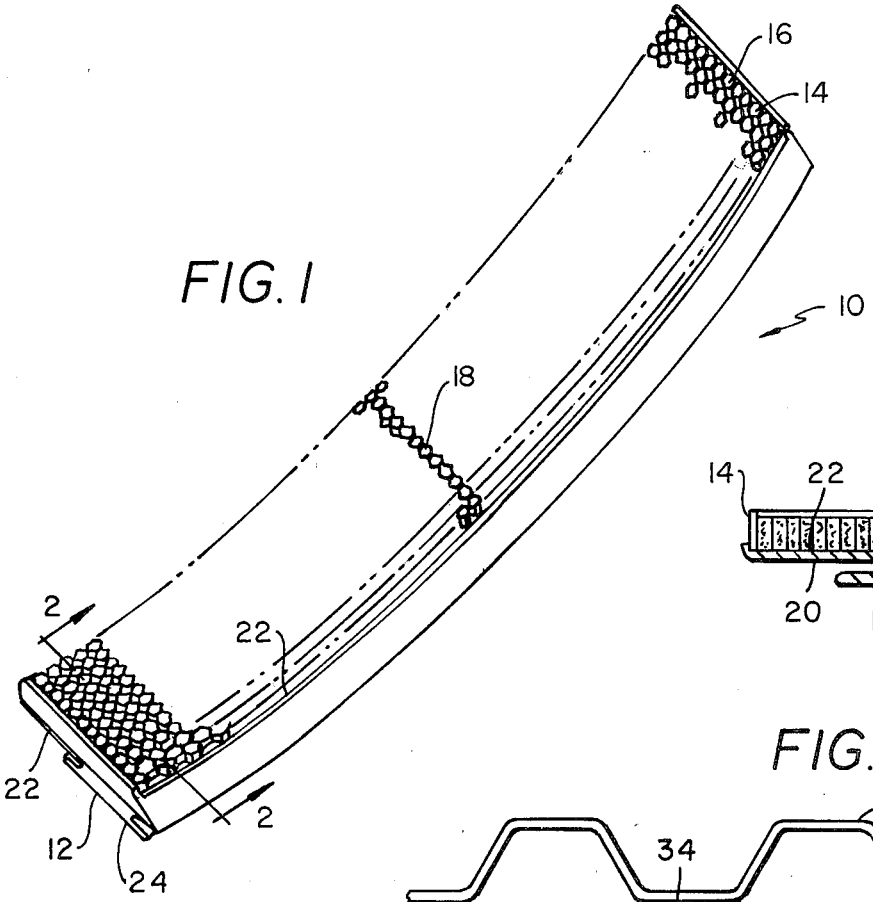
FIG. 1 is a perspective view of a turbine shroud section including mechanical locking means between the abradable matrix material and honeycomb structure thereof in accordance with the structure of the invention constructed in accordance with the method of the invention.

As shown best in FIG. 1, the turbine engine shroud section 10 includes an arcuate base 12, honeycomb structure 14 secured to the base 12, and an abradable matrix material 16 positioned within the honeycomb structure. Mechanical locking or detent means 18 is shown operable between the honeycomb structure 14 and abradable matrix 16 in accordance with the invention. In use, the locking means 18 prevents the abradable matrix material 16 from separating from the honeycomb structure 14.

Figure 2:
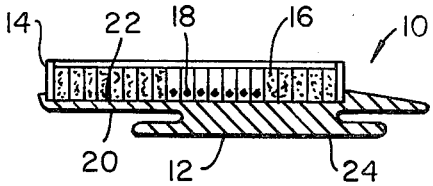
FIG. 2 is an enlarged transverse section view of the shroud section illustrated in FIG. 1, taken substantially on the line 2—2 in FIG. 1.

More specifically, the base 12 is an arcuate steel member having a convex side 20 and a concave side 22. The base 12 has a dovetail cross section portion 24 best shown in FIG. 2 which is utilized to secure the base 12 to the casing of a jet engine or the like.

Figure 3:
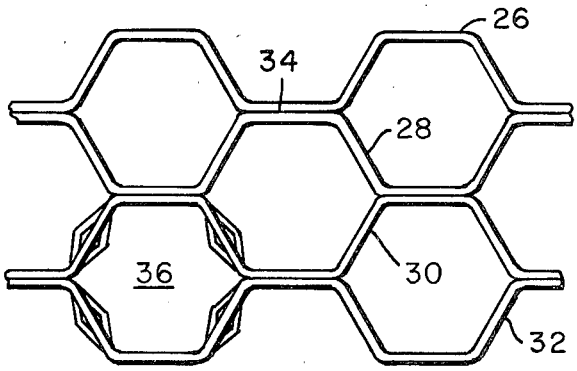
FIG. 3 is an enlarged plan view of a portion of the honeycomb structure of the shroud section of FIGS. 1 and 2 showing one of the honeycomb cells split and deformed to provide a mechanical bond between the honeycomb structure and matrix material of the shroud section.

The honeycomb structure 14 as best shown in FIG. 3 is constructed of a plurality of separate strips such as strips 26, 28, 30 and 32 bent as shown in FIG. 3 to form one half of six-sided honeycomb cells on opposite sides thereof alternately along its length. The strips 26 and 28, 30 and 32 are secured together as by welding or the like at junctions such as junction 34 to provide the basic honeycomb structure 14.

The honeycomb structure 14 which is thus separately constructed is secured to the concave surface 22 of the base 12 by convenient means such as welding or the like.

The abradable material 16 is positioned in the individual cells of honeycomb structure 14 such as cell 36 and the shroud section 10 having the abradable material in the cells of the honeycomb structure is sintered at for example 1900° to 1950°.

The abradable material 16 may for example be a blend of nickel and aluminum powder consisting of 75% nickel coated aluminum powder and 25% by weight nickel powder. The nickel aluminum and nickel powder may be mixed with an organic binder comprising two grams of ammonium algonate to 100 milliliters of distilled water. The powder and binder are mixed to a pliable consistency.

In the past, when such abrasive material 16 is placed in the honeycomb structure 14 and sintered, it is expanded so that the nickel coated aluminum particles engage the walls of the honeycomb structure. Where there was no visible line between the nickel coated aluminum particles and the honeycomb structure and there was said to be a bond between the abradable matrix material 16 and the honeycomb structure. Approximately 65 bonds per inch of honeycomb structure has in the past been determined to provide an acceptable bond between the matrix material and the honeycomb structure.

According to the present invention, however, the separate honeycomb strips such as strips 30 and 32 for example of the honeycomb material of FIG. 3 are selectively split and deformed prior to their being assembled in the honeycomb structure and welded together. As shown best in FIGS. 3 through 6, the splitting and deforming contemplated provides detents or locking means 18, for positively mechanically locking the abradable matrix material 16 in the individual cells such as cell 36 of the honeycomb structure 14. Thus, the matrix material 16 is positively prevented from separating from the honeycomb structure 14.

Figure 4:
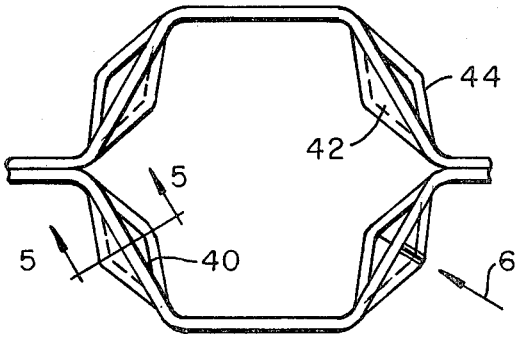
FIG. 4 is a further enlarged plan view of the one split and deformed honeycomb cell of the honeycomb structure illustrated in FIG. 3.
Figure 6:
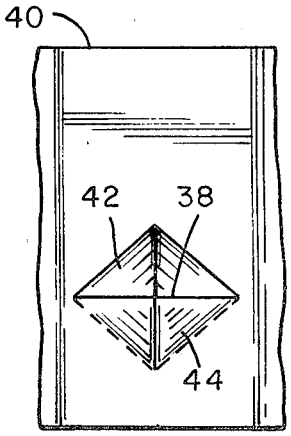
FIG. 6 is a partial elevational view of the split and deformed honeycomb cell illustrated in FIG. 4, taken substantially in the direction of arrow 6 in FIG. 4.

In a preferred embodiment of the invention, the locking means 18 is accomplished by a diamond shaped splitting and deforming of one or more of the six side walls of a cell 26 of the honeycomb material 14 as shown best in FIG. 4. The splitting and deforming illustrated in FIG. 4 is substantially diamond shaped as shown in FIG. 6 with the honeycomb material split at 38 substantially parallel to the concave surface 22 of the base 12.

Figure 5:
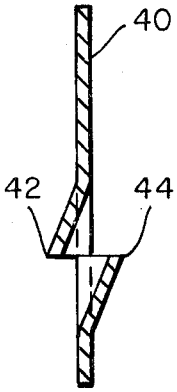
FIG. 5 is a section view of the split and deformed honeycomb cell illustrated in FIG. 4, taken on the line 5—5 in FIG. 4.

As shown best in FIG. 5, the upper and lower portions of the lanced side wall 40 are deformed in opposite directions into the individual cells of the honeycomb material 14 to which they are adjacent. As shown in FIG. 5, the upper portion 42 and the lower portion 44 of the split and deformed portion of the side wall 40 of the honeycomb structure 14 have their maximum deformation centrally of the split 38. The general configuration of the splitting and deforming is then a diamond shape and provides a diamond shaped structure producing mechanical locking in both adjacent honeycomb cells that have the common side wall 40.

As in the past, with the honeycomb structure 14 constructed with the lanced portions therein as shown in FIG. 3, the honeycomb structure 14 is secured to the base 12 and the abradable matrix material 16 is placed in the individual cells of the honeycomb structure 14. The shroud section 10 is then sintered to provide the previous bonding between the particles of the abradable matrix material 16 and the honeycomb structure 14 and base 12. However, in accordance with the invention there is also provided the positive mechanical locking between the individual cells 36 by the locking means 18 provided by the lanced side walls such as side wall 40.

Figure 7:
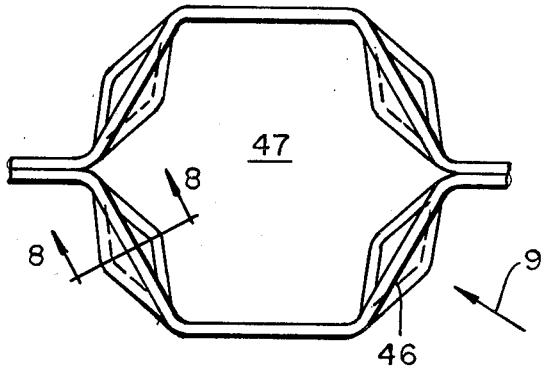
FIG. 7 is an enlarged plan view of a portion of a honeycomb cell similar to FIG. 4 split and deformed in a different manner to provide a mechanical bond between the honeycomb structure and abradable material.
Figure 8:
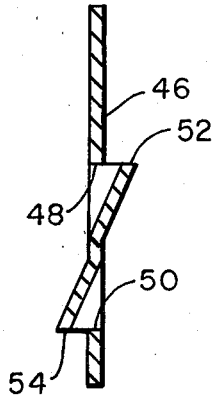
FIG. 8 is a section view of the split and deformed honeycomb cell illustrated in FIG. 7, taken on the line 8—8 in FIG. 7.
Figure 9:
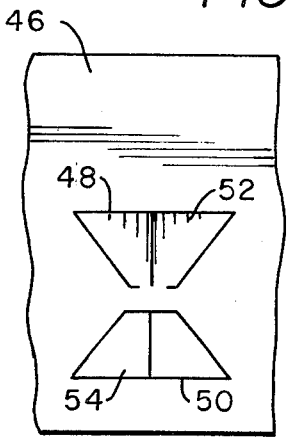
FIG. 9 is a partial elevation view of the split and deformed honeycomb cell illustrated in FIG. 7, taken in the direction of arrow 9 in FIG. 7.

Other mechanical locking means is contemplated. Thus, in FIGS. 7, 8 and 9, a generally X-shaped splitting and deforming configuration is utilized. In such configuration, a side wall 46 of an individual cell 47 of a honeycomb structure is split at 48 and 50 and the upper and lower ends 52 and 54 of the lanced portion of the side wall 46 are deformed to have their maximum dimension again at the splits 48 and 50, all as shown in FIGS. 7, 8 and 9.

The X-shaped split and deformed structure shown in FIGS. 7, 8 and 9 again provides mechanical detents or locking means to prevent separation of the abradable matrix material from the honeycomb structure.

While one embodiment of the present invention has been considered in detail, it will be understood that other embodiments and modifications thereof are contemplated. It is the intention to include all such embodiments and modifications as are defined by the appended claims within the scope of the invention.

I claim:

1. A shroud for a turbine engine or the like comprising an arcuate base member having a convex side with a convex surface and a concave side with a concave surface including means for securing the shroud to a turbine engine casing, a six-walled, two ended cell, honeycomb structure secured to the base on the concave side thereof, a matrix of abradable material within the honeycomb structure, and mechanical locking means operable between the honeycomb structure and abradable matrix material for securing the abradable matrix material within the honeycomb structure including portions of at least some of the walls of the cells being deformed transversely only between and in spaced relation to the ends of the cells so as to extend into the cells and comprising split and deformed portions of walls of the cells extending into the abradable matrix material wherein the split and deformed portions of the honeycomb structure are deformed in a diamond configuration with the center of the diamond configuration split substantially parallel to the concave surface of the base and the upper and lower portions of the diamond shaped deformed portion of the honeycomb material extend in opposite directions into adjacent cells with their maximum deformation appearing at the split center of the diamond configuration.

* * * * *